US006099374A

United States Patent [19]

Watanabe et al.

[11] Patent Number: 6,099,374

[45] Date of Patent: Aug. 8, 2000

[54] LUBRICATION AND OIL DRAIN SYSTEM FOR 4 CYCLE OUTBOARD MOTOR

[75] Inventors: Takahide Watanabe; Masanori Takahashi; Hitoshi Watanabe, all of Hamamatsu, Japan

[73] Assignee: Sanshin Kogyo Kabushiki Kaisha, Hamamatsu, Japan

[21] Appl. No.: 09/131,969

[22] Filed: Aug. 11, 1998

[30] Foreign Application Priority Data

Aug. 14, 1997 [JP] Japan ..... 9-219490
Aug. 14, 1997 [JP] Japan ..... 9-219497

[51] Int. Cl.[7] ..... B63H 21/10

[52] U.S. Cl. ..... 440/88; 123/196 M; 123/196 W

[58] Field of Search ..... 440/88, 89, 113, 440/900; 123/195 P, 196 W, 196 CP, 196 M

[56] References Cited

U.S. PATENT DOCUMENTS 4,928,641 5/1990 Niizato et al. ..... 123/196 M
5,123,385 6/1992 Sado et al. ..... 123/196 M
5,163,394 11/1992 Koishikawa et al. ..... 440/88
5,524,581 6/1996 Rush, II et al. ..... 123/196 W
5,687,688 11/1997 Tsunoda et al. ..... 123/196 W
5,704,819 1/1998 Isogawa ..... 440/88
5,845,616 12/1998 Schwarzenthal et al. ..... 123/196 M

*Primary Examiner*—S. Joseph Morano
*Assistant Examiner*—Lars A. Olson
*Attorney, Agent, or Firm*—Knobbe, Martens, Olson & Bear LLP

[57] ABSTRACT

An outboard motor having a multi-cylinder four-cycle, internal combustion engine as a power plant. The engine is provided with an oil reservoir in the upper portion of the drive shaft housing and lower unit. Oil is drained back to this oil reservoir by separate drain passages formed in the cylinder head and in the crankcase. In addition, an improved crankcase ventilating system is provided wherein the crankcase ventilating gases follow a circuitous path through the crankcase chamber, camshaft chambers and then to the intake system so as to reduce the emissions of hydrocarbons.

17 Claims, 13 Drawing Sheets

LUBRICATION AND OIL DRAIN SYSTEM FOR 4 CYCLE OUTBOARD MOTOR

BACKGROUND OF THE INVENTION

This invention relates to a four-cycle internal combustion engine lubrication system and more particularly to a lubrication system particularly adapted for use with four-cycle outboard motors.

For a variety of reasons, it has been proposed to substitute four-cycle engines for the more conventionally used two-cycle engines as power plants for outboard motors. One of the main reasons for this substitution is the fact that four-cycle engines may tend to be more environmentally suitable for this application than two-cycle engines.

One of the reasons for the preference of using four-cycle engines, however, also complicates the construction of the outboard motor. With a four-cycle engine, unlike a two-cycle engine, the lubricant is not spent and discharged from the combustion chamber of the engine. Rather, the lubricant is recirculated and hence not discharged to the atmosphere. This means, however, that there must be some provision within the outboard motor to hold adequate lubricant for engine lubrication for relatively long periods of time.

It generally has become the practice to position the oil reservoir for the engine in the upper portion of the drive shaft housing. This is done for a variety of reasons, not the least of which is to maintain a lower center of gravity for the power head. This, however, raises certain problems in connection with the design and configuration of the lubricating system for the engine.

Frequently, with normal four-cycle applications, the crankcase also forms the oil reservoir. This is done in so-called "wet sump" engines. However, in an outboard motor application, the engine is generally mounted in the power head so that its crankshaft extends about a vertically extending axis. This is done to facilitate connection of the engine output shaft to the drive shaft for the propulsion unit of the outboard motor. This means that the crankcase also extends vertically and conventional type of wet sump engines cannot be employed.

The positioning of the oil reservoir in the drive shaft housing presents some problems because of the use of this area for exhaust treatment. Nevertheless, this is generally the preferred location for the oil reservoir.

Thus, there becomes a problem in the design of the arrangement for retuning the lubricant to the oil reservoir from the engine. This problem is compounded when one or more overhead camshafts are employed. That is, in conventional vertical engine disposition, the cylinder head drains back into the crankcase chamber through the cylinder block. This is not as feasible, however, with vertical crankshaft positioning.

It is, therefore, a principal object of this invention to provide an improved oil drain arrangement for a four-cycle outboard motor having at least one overhead camshaft.

Also, it is generally the practice to utilize a crankcase ventilation system with engines for this purpose. However, in order to ventilate the crankcase and also return oil, care must be taken that the ventilating path does not overlap significantly with the oil return path. If it does, there is a danger that the ventilating gases may pick up large amounts of oil and deliver them into the ventilating system which is obviously undesirable.

It is, therefore, a still further object of this invention to provide an improved and simplified oil drain system for a four-cycle outboard motor wherein the drain passages are clear of the crankcase ventilating system.

The vertical positioning of the crankshaft also can give rise to certain problems in connection with drainage of the oil from the various components. This is particularly true in the crankcase area because of the provision of journals for the crankshaft. An arrangement must be provided that permits the oil to drain from the various bearings of the crankcase to the lower end and flow smoothly from the lower end back into the oil reservoir. It is, therefore, a still further object of this invention to provide an improved oil return system for the crankcase of a four-cycle outboard motor.

SUMMARY OF THE INVENTION

A first feature of this invention is adapted to be embodied in an outboard motor arrangement having a power head consisting of a four-cycle, overhead camshaft, internal combustion engine and a surrounding protective cowling. The engine is supported so that the crankshaft and at least one overhead camshaft rotate about vertically extending axes. The vertical positioning of the crankshaft facilitates connection of the crankshaft to a drive shaft that depends into a drive shaft lower unit depending from the power head and which contains a propulsion device driven by the drive shaft for propelling an associated watercraft. The crankshaft is journaled in a crankcase chamber formed at one end of a cylinder block and the camshaft is supported for rotation in a camshaft chamber formed in a cylinder head at the other end of the cylinder block. An oil reservoir is provided for the engine in the area at the upper end of the drive shaft housing and lower unit. The camshaft chamber and the crankcase chamber each have independent drains to the oil reservoir.

Another feature of the invention is also adapted to be embodied in a four-cycle overhead camshaft outboard motor of the type described. In connection with this feature, the crankshaft is journaled for rotation by a plurality of main bearings including a lower main bearing that is formed in a lowermost surface of the crankcase assembly. A pocket area is formed in the area adjacent this bearing and which pocket communicates with a drain passage for draining oil from the crankcase chamber to the oil reservoir.

DETAILED DESCRIPTION OF THE PREFERRED EMBODIMENTS OF THE INVENTION

Figure 1:
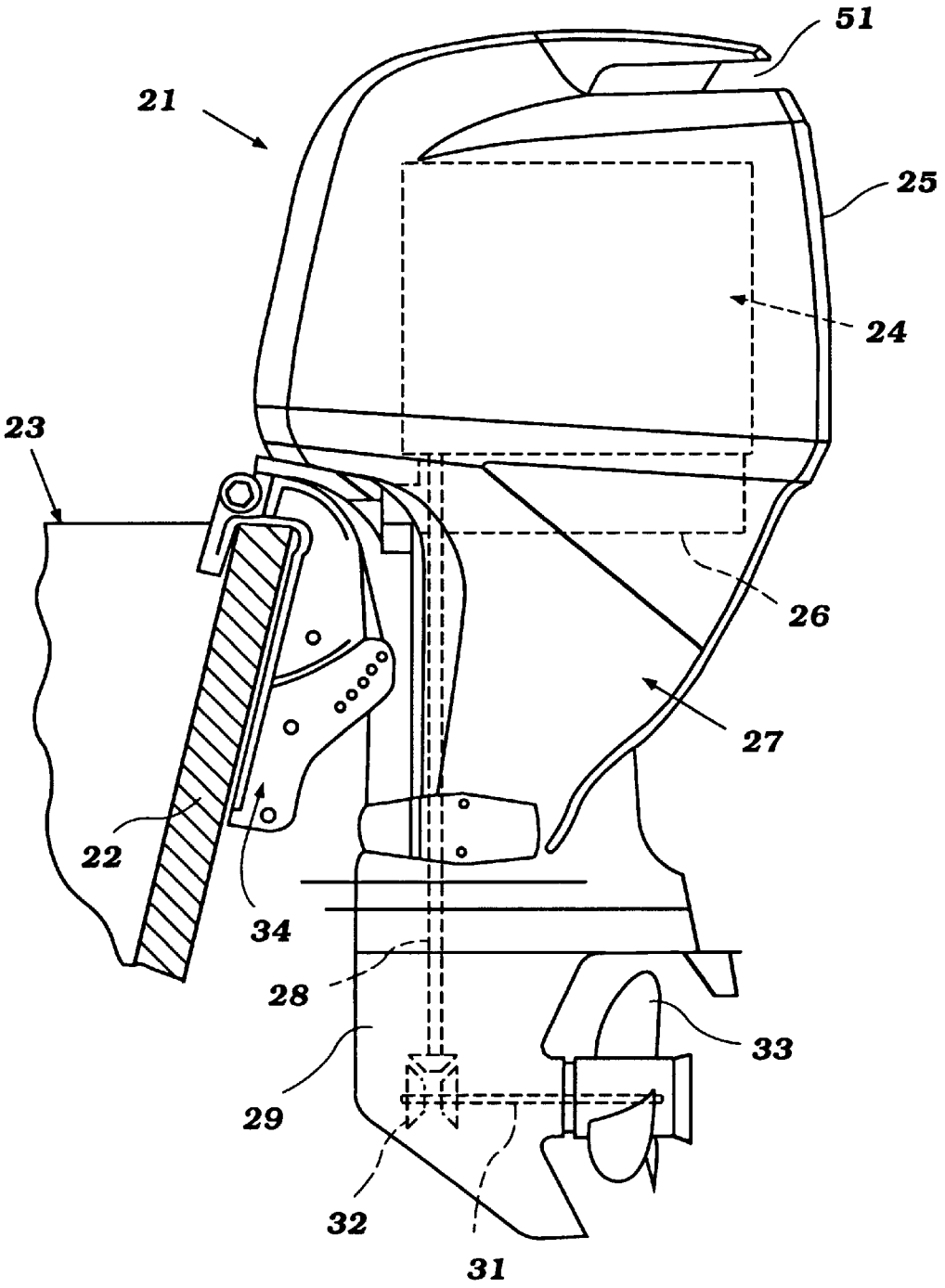
FIG. 1 is a side elevational view of an outboard motor constructed in accordance with an embodiment of the invention and illustrated as attached to the transom of an associated watercraft, which is shown partially and in cross section.

Referring now in detail to the drawings and initially to FIG. 1, this Figure illustrates an outboard motor, indicated generally by the reference numeral 21, attached to the transom 22 of an associated watercraft which is shown partially and identified generally by the reference numeral 23. This Figure may be considered to be typical of all of the embodiments disclosed herein.

Although the invention deals primarily with the engine which forms the propulsion unit for the outboard motor 21, shown in block form in FIG. 1 and identified generally by the reference numeral 24, it will be understood by those skilled in the art that the invention is capable of use with other applications than outboard motors. However, the invention has particular utility in conjunction with outboard motors due to the fact that they are designed so that their crankshaft rotates about the vertically extending axis for a reason which will become apparent shortly. The engine 24 forms a part of the power head of the outboard motor 21 and this power head is completed by a surrounding protective cowling 25.

The engine 24 is mounted on an exhaust guide plate 26 that is positioned at the upper end of a drive shaft housing and lower unit, indicated generally by the reference numeral 27. A driveshaft 28 is journaled in this drive shaft housing and lower unit 27 for rotation about a vertically extending axis. It is because of this orientation of the axis of drive shaft 28 that the engine 24 is mounted so that its crankshaft rotates about a vertically extending axis. This is done so as to facilitate a direct connection between the engine crankshaft and the drive shaft 28.

The drive shaft 28 depends into a lower unit portion 29 of the drive shaft housing and lower unit 27. There, it drives a propeller shaft 31 selectively through a forward, neutral, reverse transmission 32. This type of transmission is well known in the art. A propeller 33 is affixed for rotation with the propeller shaft 31 so as to create a propulsion for the associated watercraft 23.

The outboard motor 21 is completed by a combined swivel bracket and clamping bracket assembly, indicated generally by the reference numeral 34 by which the outboard motor is attached to the transom 21 for steering movement about a vertically extending axis and for tilt and trim movement about a horizontally extending axis.

The aforenoted description of the outboard motor is, as noted, so as to permit those skilled in the art to understand an environment in which the invention may be employed. Obviously, those skilled in the art will understand how to apply the invention's principles to any type of outboard motor structure or, as noted above, any arrangement where a four-cycle engine is positioned so that its crankshaft rotates about a vertically extending axis.

The construction of the engine 24 will now be described, initially by reference primarily to FIGS. 2–5 although the components appearing therein also appear in other figures. In the illustrated embodiment, the engine 24 is of the four cylinder, inline type and operate on a four-stroke principle. Although the invention can be employed with engines having other cylinder numbers and other cylinder orientations, the four cylinder construction described will provide adequate information so as to permit those skilled in the art to be able to practice the invention with such other arrangements.

The engine 24 is comprised of a cylinder block 35 in which four horizontally extending, vertically spaced, cylinder bores 36 are formed. One end of the cylinder bores 36 are closed by a crankcase member 37 which is affixed to the cylinder block 35 in a manner to be described and which defines a crankcase chamber in which the engine crankshaft 38 rotates about a vertically extending axis.

The bearing arrangement for the crankshaft 38 is provided by bearing webs 39 (FIG. 5) that are formed in the cylinder block 35 and cooperating bearing portions 41 formed by the crankcase member 37. The crankcase member 37 is affixed to the cylinder block 36 in the area of these bearings and, if desired, at other locations by threaded fasteners 42.

Figure 5:
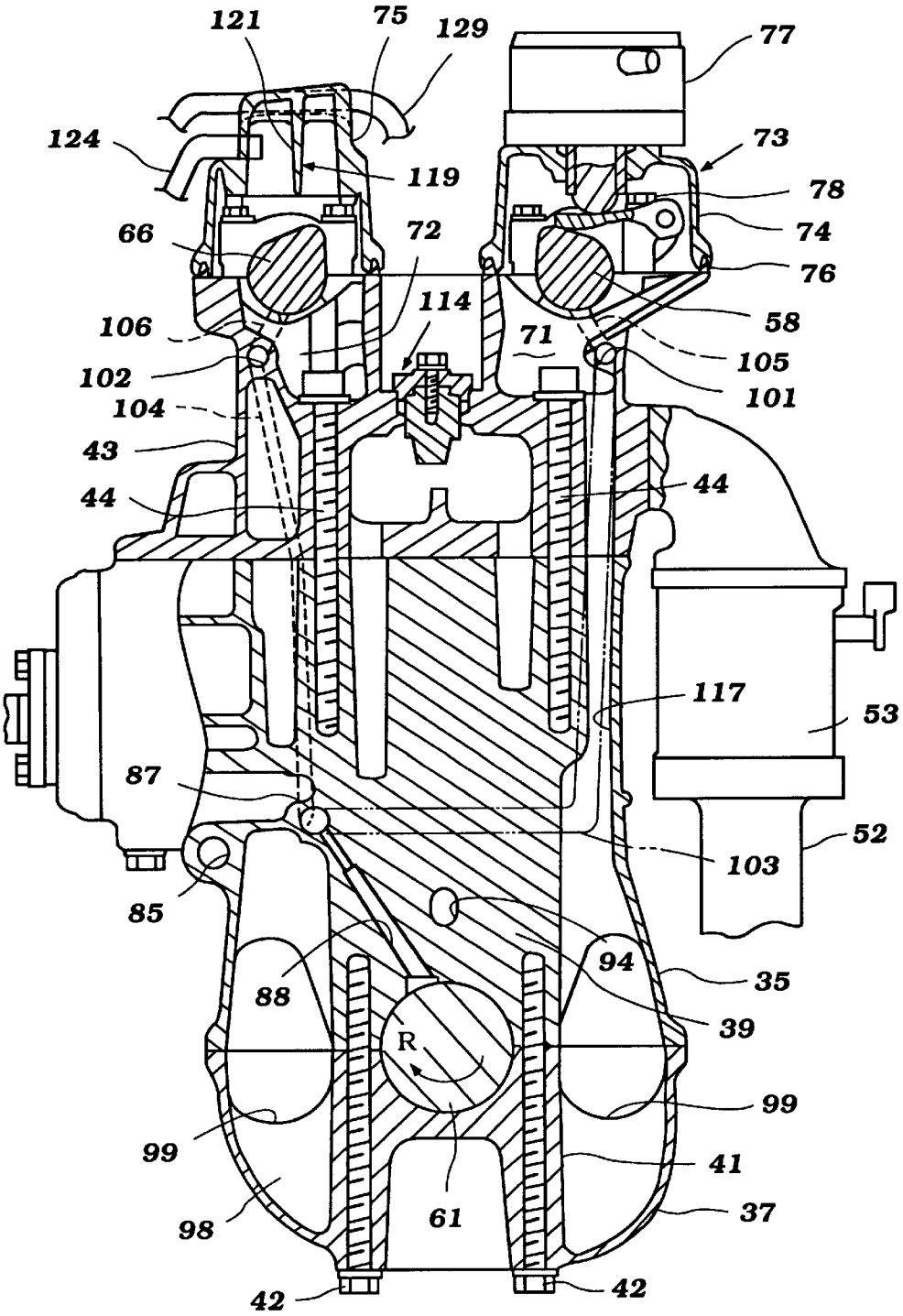
FIG. 5 is a cross-sectional view through the engine and taken along the line 5—5 of FIG. 4.

The opposite ends of the cylinder bores 36 are closed by a cylinder head assembly that is comprised primarily of a main cylinder head member 43. This cylinder head member 43 is affixed to the cylinder block 35 by threaded fasteners 44 (FIG. 5).

Pistons 45 are slidably supported in the cylinder bores 36. These pistons 45 are connected to the small ends of connecting rods 46 by piston pins. The big ends of these connecting rods 46 are journaled on the throws of the crankshaft 38 in a manner well known in the art. The cylinder head 43 is formed with recesses 47 that cooperate with the heads of the pistons 45 and the cylinder bores 36 to define the combustion chambers of the engine.

An induction system positioned primarily on the left hand side of the outboard motor 21 is provided for delivering an air charge to these combustion chambers. This induction system includes a generally vertically extending air inlet device and silencer mechanism 48 that is disposed adjacent the forward end of the crankcase member 37 and which has a sidewardly directed air inlet opening 49. This inlet opening 49 admits air that has been drawn into the protective cowling 25 through a rearwardly facing air inlet opening 51 (FIG. 1).

The air from the inlet device 48 passes through a plurality of runner sections 52 to throttle bodies 53. The throttle bodies 53 have throttle valves positioned in them that are controlled by the operator through a suitable linkage or cable system.

Air passing through the throttle bodies 53 is delivered to an intake manifold 54 that has runner sections 55, each of which cooperates with one or more intake passages 56 formed in the cylinder head assembly and specifically the main cylinder head member 43. These intake passages terminate at intake valve seats formed in the cylinder head recesses 47. An intake valve arrangement 57 is mounted in the cylinder head assembly and specifically the main cylinder head member 43 for controlling the flow through these intake valve seats.

These intake valves 57 are actuated by the lobes of an intake camshaft 58 that is rotatably journaled in the cylinder head member 43 in a manner that will be described. This intake camshaft 58 is driven by a timing belt 59 from a drive sprocket 61 fixed to an upper end of the crankshaft 38 at one-half crankshaft speed. An intake camshaft sprocket 62 is affixed to one end of the intake camshaft 58 for this purpose.

Figure 4:
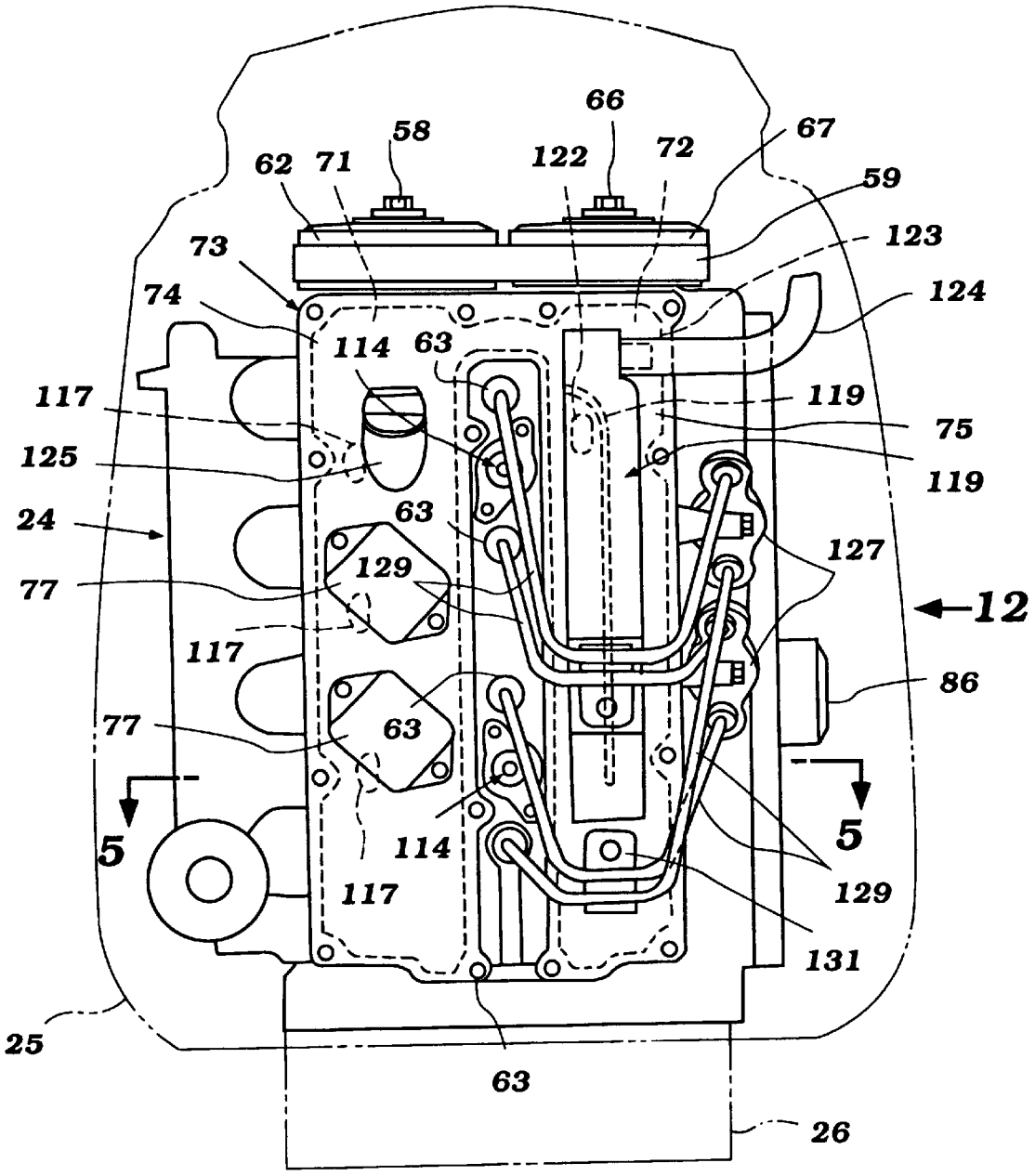
FIG. 4 is a rear elevational view of the power head again showing the engine in solid lines and the surrounding protective cowling in phantom.

As seen best in FIG. 4, spark plugs 63 are mounted in the cylinder head assembly and specifically the main cylinder head member 43. These spark plugs 63 have their spark gaps disposed in the recessed area 47 for firing a fuel air charge which has been formed therein.

This fuel air charge may be formed by utilizing either one or more carburetors, which can be positioned as the throttle body 53 or by means of a fuel injection system. The fuel injection system may include injectors that inject fuel into either the induction system or directly into the cylinder head recesses 47. Since this fuel charging system forms no part of the invention, it has not been illustrated and those skilled in the art will readily understand how the invention can be utilized in conjunction with any wide variety of types of charge formers.

The ignited charge will burn and expand so as to drive the pistons 45 in the cylinder bores 36 and effect rotation of the crankshaft 38 as is well known in the art.

The burned charge is discharged from the combustion chambers through an exhaust system which is generally formed on the opposite side of the engine from the intake system. This includes one or more exhaust passages 64 formed in the cylinder head body 43 and which originate at exhaust valve seats formed in the cylinder head recesses 47. Poppet type exhaust valves 65 valve these exhaust valve seats.

Like the intake valve 57, the exhaust valves 65 are operated by any known type of mechanism which includes the cam lobes of an exhaust camshaft 66 that is journaled in the cylinder head member 43 for rotation about an axis that is parallel to the axis of rotation of the intake camshaft 58 and the crankshaft 38. This journal arrangement will also be described in more detail later. A driven sprocket 67 is affixed to the upper end of the exhaust camshaft 66 and is also driven by the drive belt 59 at one-half crankshaft speed.

The cylinder head exhaust passages 64 have a reentrant curvature and communicate with manifold runner sections 68 formed in a facing surface of the cylinder block 35. These manifold runners 68 communicate with a collector section 69 which extends vertically downwardly and which cooperates with an exhaust system through at the exhaust guide plate 26.

This exhaust system may have any known type of silencing mechanism and generally consists of a high-speed, underwater exhaust discharge and an idle above the water exhaust discharge. Since these systems are well known, further description of them is not believed to be necessary to permit those skilled in the art to practice the invention.

As seen probably best in FIG. 5, the cylinder head member 43 forms a pair of cavities in its rearward surface indicated by the reference numerals 71 and 72 which may be considered to be intake and exhaust cam chambers. These cam chambers are closed by a single cam cover 73 that has portions 74 and 75 that overlie and close the recesses 71 and 72. A sealing gasket 76 is provided in the peripheral edge of the cam cover 73 to effect a tight oil seal between it and the cylinder head member 43.

Although the charge-forming system for the engine may be of any type, as seen best in FIGS. 4 and 5, a pair of fuel pump 77 are mounted on the intake side 74 of the cam cover 73. These are operated from cam lobes on the intake camshaft 58 via finger followers 78 so as to effect their pumping operation.

A lubricating system is provided for the engine 24. This lubricating system will be described now beginning initially by reference to FIGS. 3 and 5. The lubricating system is comprised of an oil reservoir 79 which is mounted on the underside of the exhaust guide plate 26 and which depends into the drive shaft housing and lower unit 27 and more particularly to the upper portion of the drive shaft housing part thereof.

Oil is picked up from this oil reservoir 79 by a pick-up tube 81 of an oil pump assembly, indicated generally by the reference numeral 82. The oil pump assembly 82 includes a drive gear 83 fixed to the lower end of the crankshaft 61 or the upper end of the drive shaft 28 and a pumping element 84.

This pump 82 then delivers the oil to an oil delivery line 85 formed in the cylinder block 35. This oil delivery line 85 extends to the inlet side of a cartridge type oil filter 86 that is mounted on the exhaust side of the engine.

The oil discharged from the oil filter 86 flows to a main oil gallery 87 that extends longitudinally through the cylinder block 35 for delivery to the lubricated portions of the engine.

Figure 6:
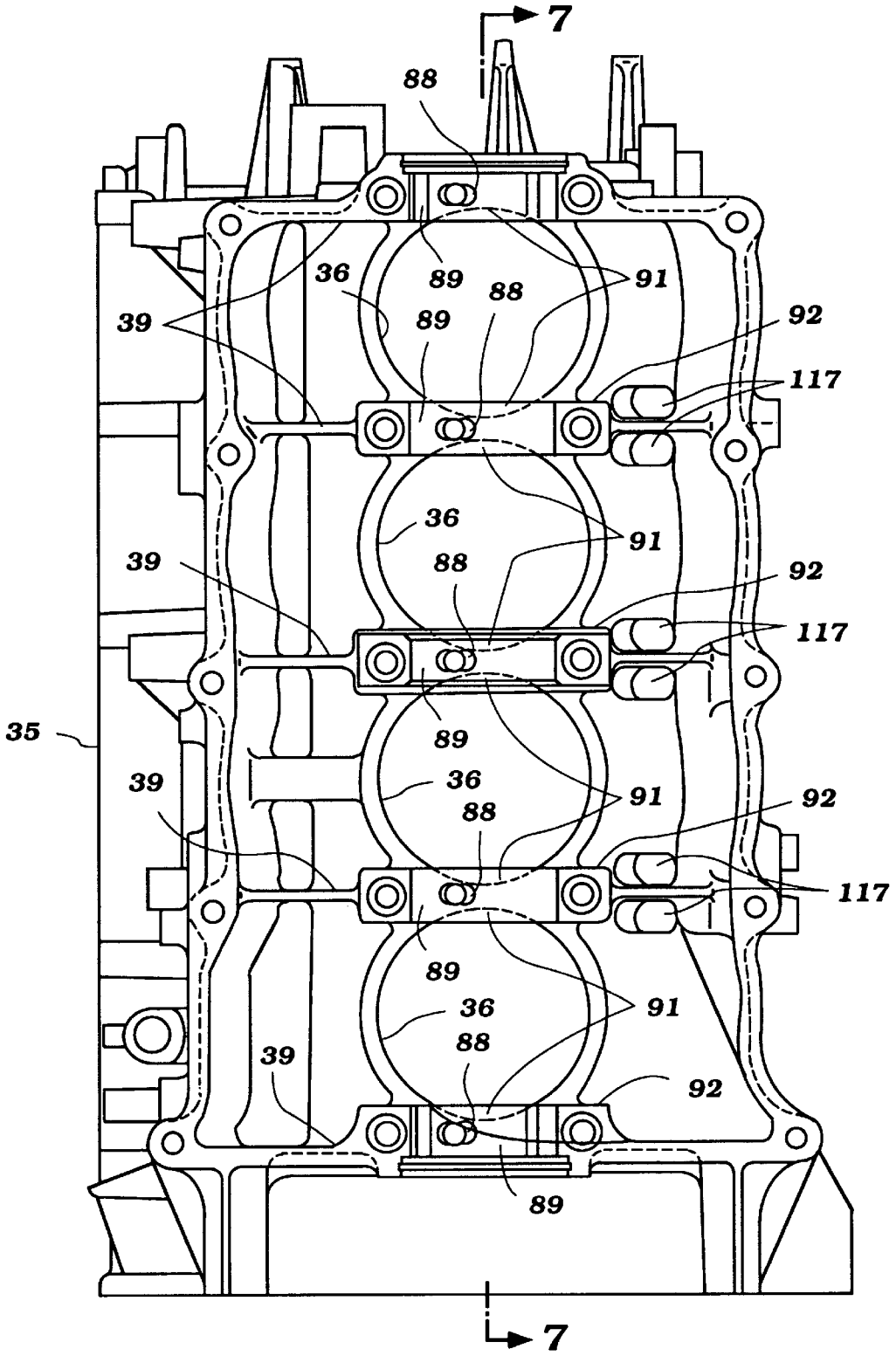
FIG. 6 is a front-elevational view showing the cylinder block of the engine with all components associated therewith removed.
Figure 7:
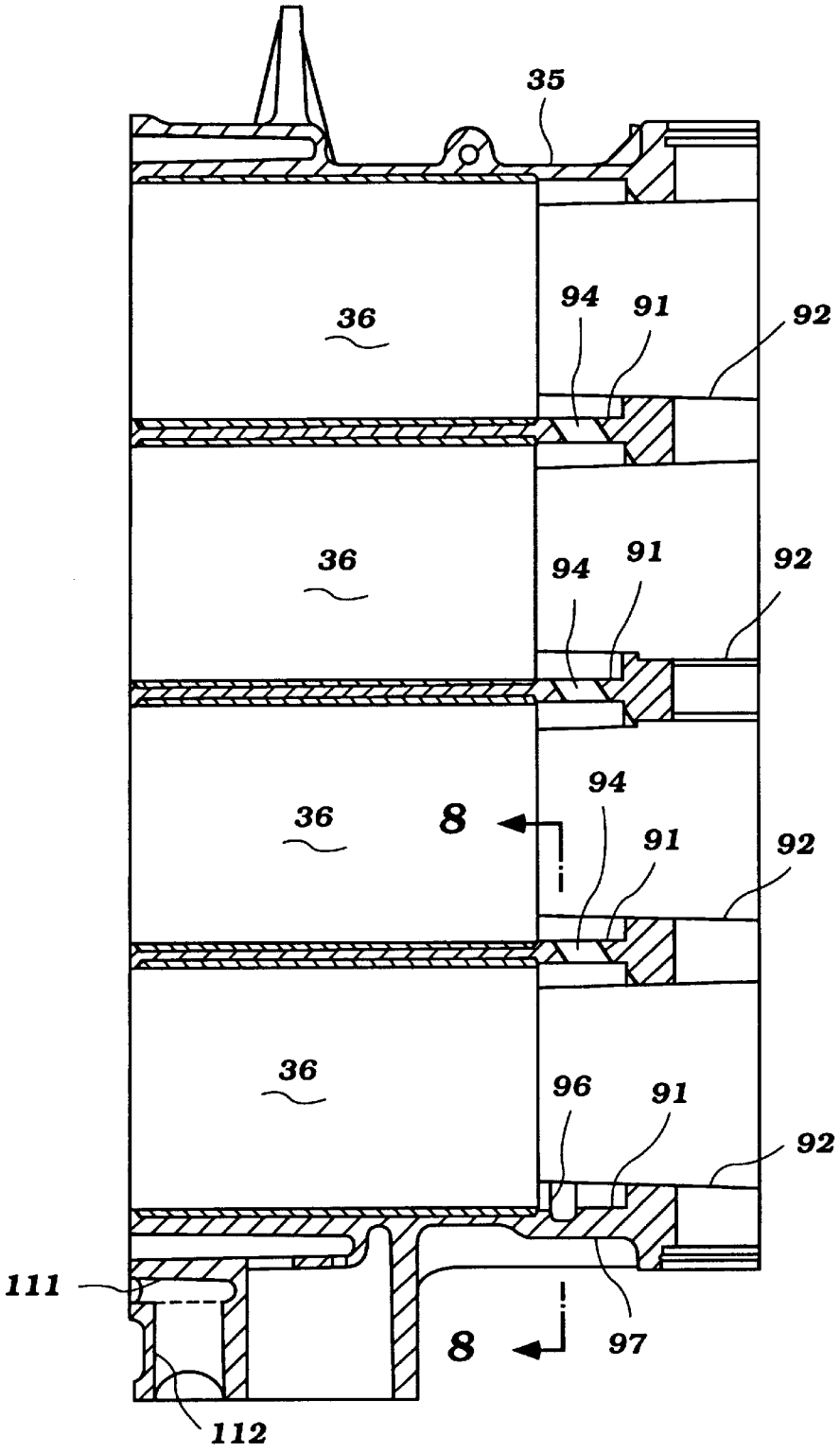
FIG. 7 is a cross-sectional view taken along the line 7—7 of FIG. 6.

Referring first to the lubrication system for the crankshaft 61, this is shown best in FIGS. 5–7. It wild be seen that the main oil gallery 87 is intersected by a plurality of drilled passages 88 that extend from bearing surfaces 89 formed by the crankshaft web portions 39. As may be seen in these figures, the web portions in the area of the bearings 89 are somewhat widened, although they are provided with cutouts 91 in the area below the cylinder bores 36 for clearance purposes. These widened areas are indicated by the reference numerals 92. Oil may flow under pressure through this path to the bearing surfaces of the crankshaft 61 for its lubrication.

Figure 3:
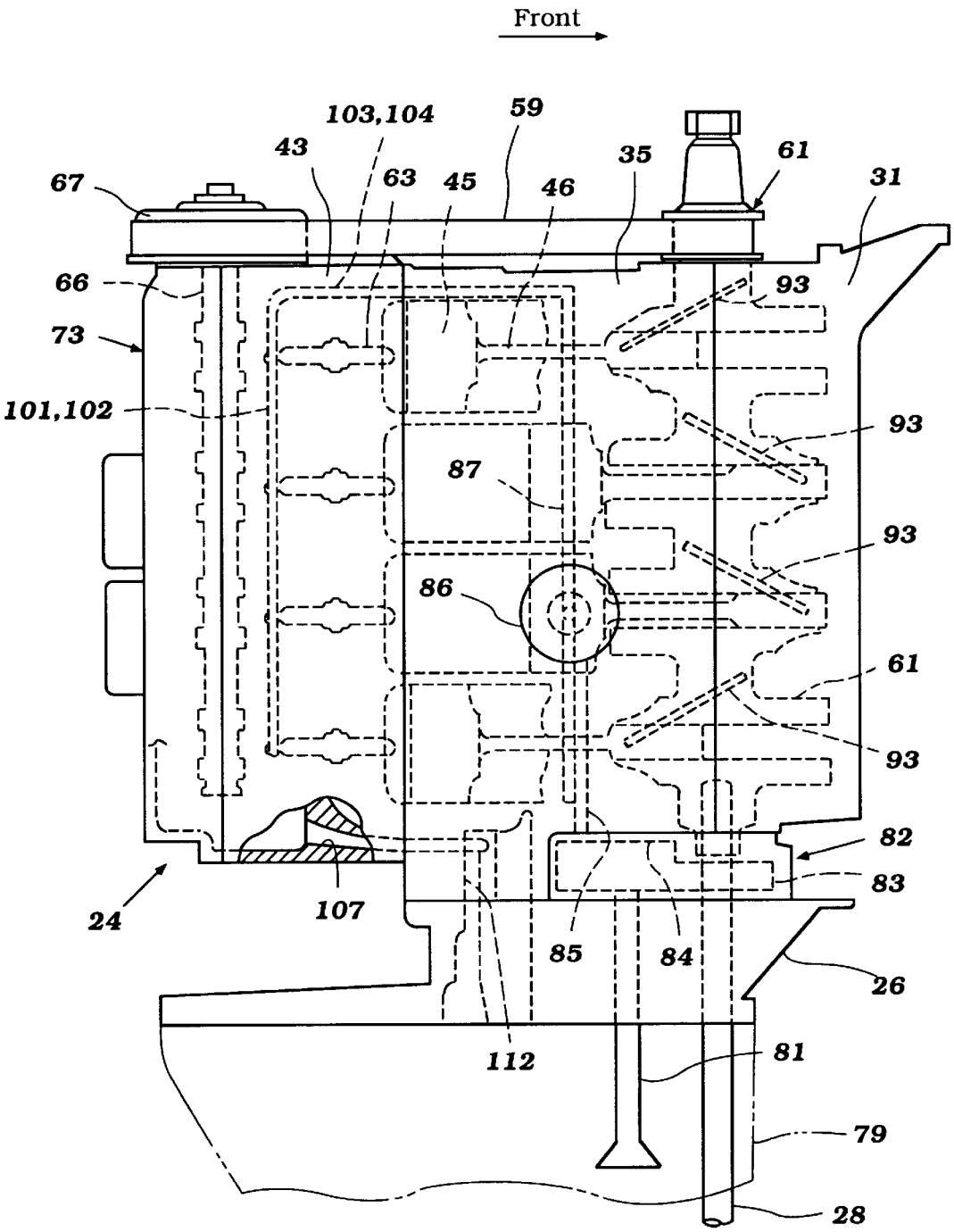
FIG. 3 is a right side elevational view, looking in the direction of the arrow 3 in FIG. 2 and showing primarily the power head with the protective cowling removed and with the part of the engine broken away and shown in section.

As best seen in FIG. 3, the crankshaft 61 is also cross-drilled, as at 93 so that lubricant may also flow from these main bearing surfaces to the journal area for the big ends of the connecting rods 46 on the throws of the crankshaft 61.

The oil that leaks through this lubricant path will flow into the crankcase chamber. To facilitate the vertically downward drainage of this oil, each of the webs 39 above the lowermost is provided with an oil drain opening 94.

Figure 8:
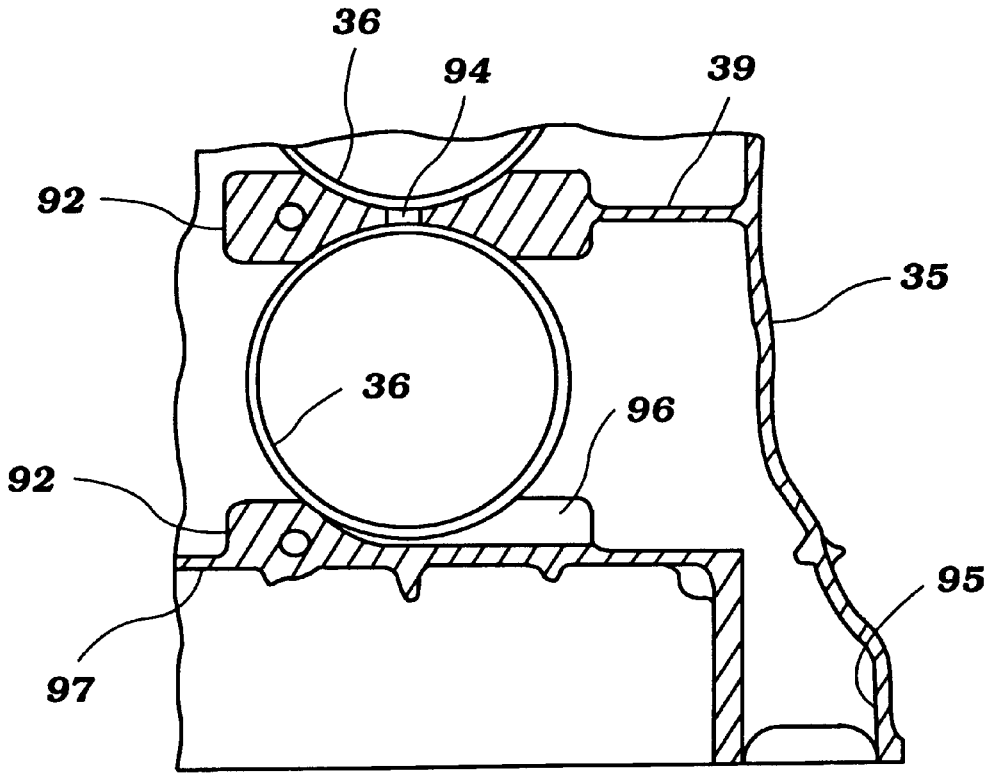
FIG. 8 is a cross-sectional view taken along the line 8—8 of FIG. 7.

Adjacent the lowermost main bearing surface 91, the cylinder block 35 is provided with an oil return drain 95 (FIG. 8). This return drain passage 95 communicates with a corresponding drain passage (not shown) formed in the exhaust guide 26 so that oil may drain back by gravity to the oil reservoir 79.

As may be best seen also in FIG. 8, the lowermost relief area 91 is formed with a drain slot 96 so as to facilitate oil being smoothly delivered from this area to the drain 95 in an area above a lower wall 97 of the cylinder block 35.

As best seen in FIG. 5, the crankcase member webs 41 are reinforced by thin outwardly extending portions 98 which may be inclined downwardly, but which nevertheless have curved openings 99 that permit the oil to drain from them into the crankcase drain which has been already described and return back to the oil reservoir 79 through the drain opening 95.

Figure 9:
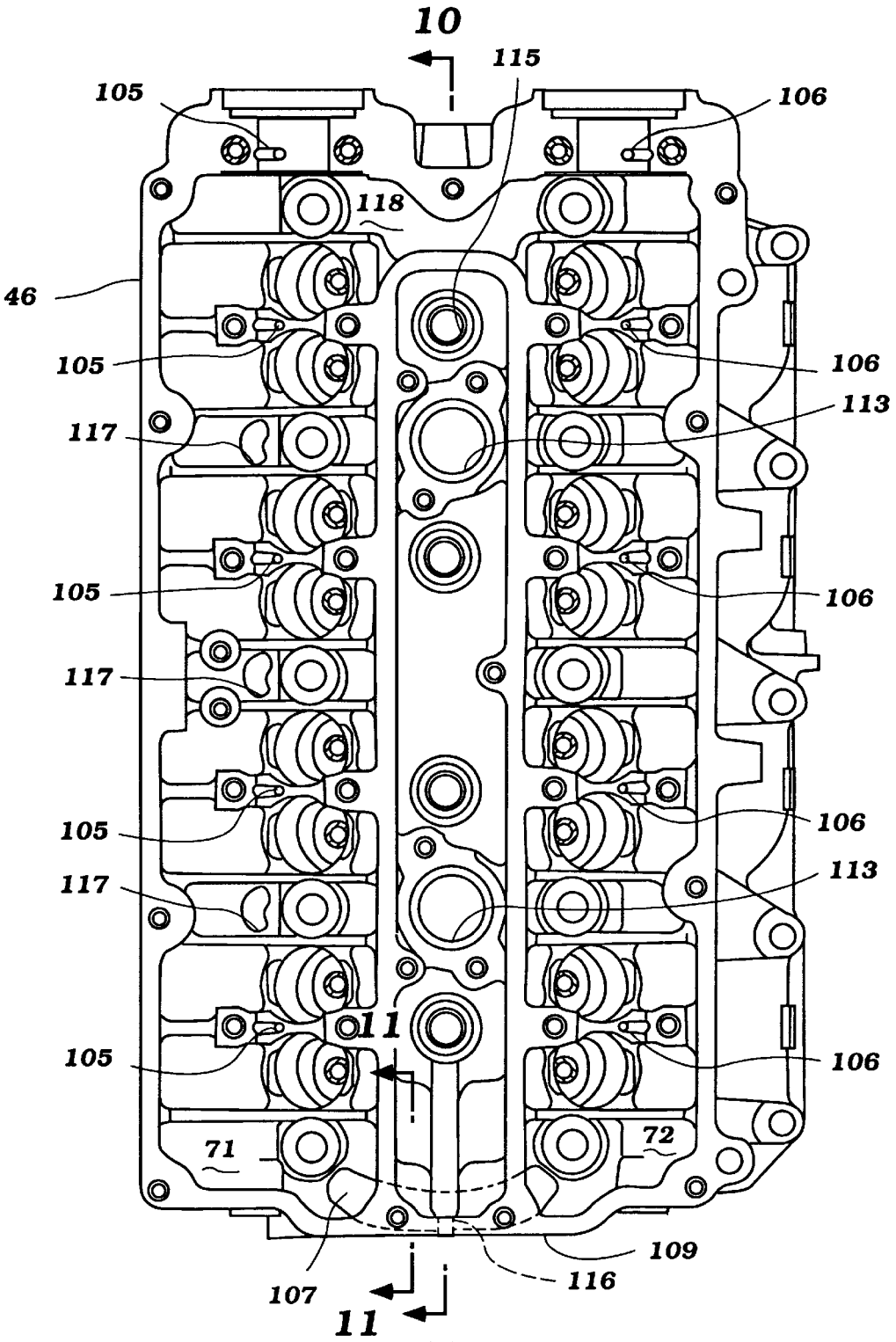
FIG. 9 is a rear elevational view of the cylinder head of the engine with all components associated with it removed.

The lubricating system for the journals for the intake and exhaust camshaft 58 and 66 will now be described by primary reference to FIGS. 3, 5 and 9. As seen in FIG. 3 and FIG. 5, the cylinder head member 43 is formed with a pair of longitudinally extending oil galleries comprised of an intake side gallery 102 and an exhaust side gallery 103. These galleries 102 and 103 are supplied from the main oil gallery 87 by drilled passages which are formed in the cylinder block 35 and cylinder head 43 and which are indicated schematically at 103 and 104.

The intake camshaft gallery 101 is intersected by a plurality of drilled passageways 105 that extend from bearing surfaces formed integrally in the cylinder head member 43 and which support the bearing surfaces of the intake camshaft 58. In a like manner, passageways 106 are drilled through corresponding bearing surfaces formed on the exhaust side of the cylinder head member 43. Bearing caps cooperate with these cylinder head bearing surfaces for journalling the camshaft. 58 and 66. Thus, the intake and exhaust camshafts 58 and 66 will be lubricated in this manner.

Figure 10:
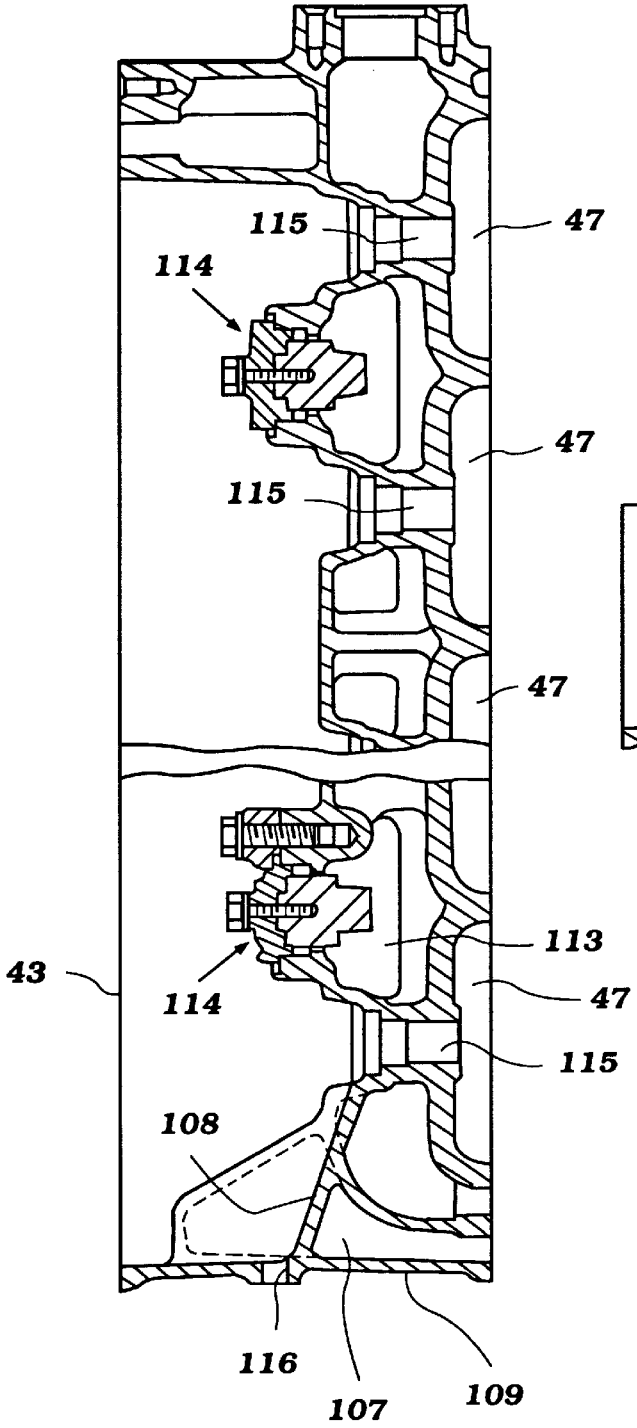
FIG. 10 is a cross-sectional view taken along the line 10—10 of FIG. 9.
Figure 11:
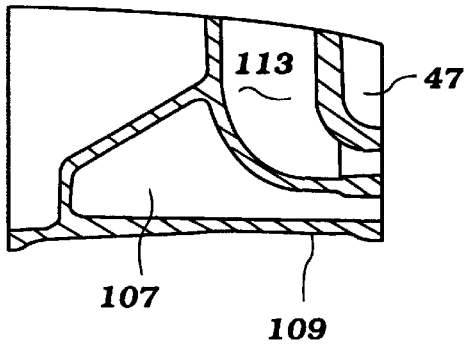
FIG. 11 is a cross-sectional view taken along the line 11—11 of FIG. 9.

The lubricant that seeps from these bearing surfaces will flow vertically downwardly along the length of the cylinder head 46. As clearly seen in FIG. 9, the intake side chamber 71 and exhaust side chamber 72 communicate with each other at the lower end thereof via a slot 107 that extends under a raised portion 108 (FIG. 10) in the lower end of the cylinder head 46. This slot 107 is formed immediately above a lower wall 109 of the outer part of the cylinder head 46. This recess 107 communicates with a corresponding recess 111 (FIG. 7) formed in the upper part of the cylinder block 35. A drain passage 112 extends from this recess 111 through the exhaust guide 26, as best seen in FIG. 3, to the oil reservoir 79 so that oil can drain back to the oil reservoir 79 through this path.

While still referring to the cylinder head 43, it should be noted that it is provided with a water cooling jacket 113 that cooperates with a corresponding cooling jacket in the cylinder block. This cooling jacket is provided with clean out holes which are closed by sacrificial anodes, indicated generally by the reference numeral 114. These sacrificial anodes 114 are disposed between the openings 115 in the cylinder head member 43 which receive the spark plugs 63. The lower part of the cylinder head wall 109 between the cam chamber portions 71 and 72, is provided with a small weep or drain hole 116 so as to permit any water which may accumulate in this area to escape.

The system for ventilating the crankcase chamber and the oil reservoir 79, as well as the cam chambers 71 and 72, will now be described by primary reference to FIGS. 3–6, 8 and 9. The blowby gases that escape past the pistons 45 into the crankcase chamber may flow downwardly into the area above the oil in the reservoir 79 through the return passage 95. In addition, these gases may flow toward the intake camshaft chamber 71 through a plurality of passages 117 that are formed in the cylinder block 35 on the intake side of the engine.

These passages 117 are basically formed between adjacent cylinders on opposite sides of the bearing webs 39 as also seen in FIG. 6. These gases then enter the intake camshaft chamber 71. While flowing through the cylinder block passages 117, any entrained oil will tend to precipitate out and drain back to the oil reservoir chamber 79 through the aforenoted oil return path.

Once in the intake camshaft chamber 71, these crankcase ventilation gases may then flow across to the exhaust camshaft chamber 72. This flow can occur both through the restricted passageway 107 at the lower end of the cylinder head 43 and also through a larger, somewhat less restricted passageway 118 formed at the upper end of the cylinder head member 46.

When these gases then enter the exhaust camshaft chamber 71, they may be discharged through a separator arrangement formed integrally in the cam cover 73 and shown best in FIG. 5 by the reference numeral 119 therein. This includes a downwardly extending baffle 121 that separates the interior of the separator 119 into a pair of sections. One of the sections is in communication with the chamber 72 through a ventilating inlet opening 122, as best seen in FIG. 4.

Figure 2:
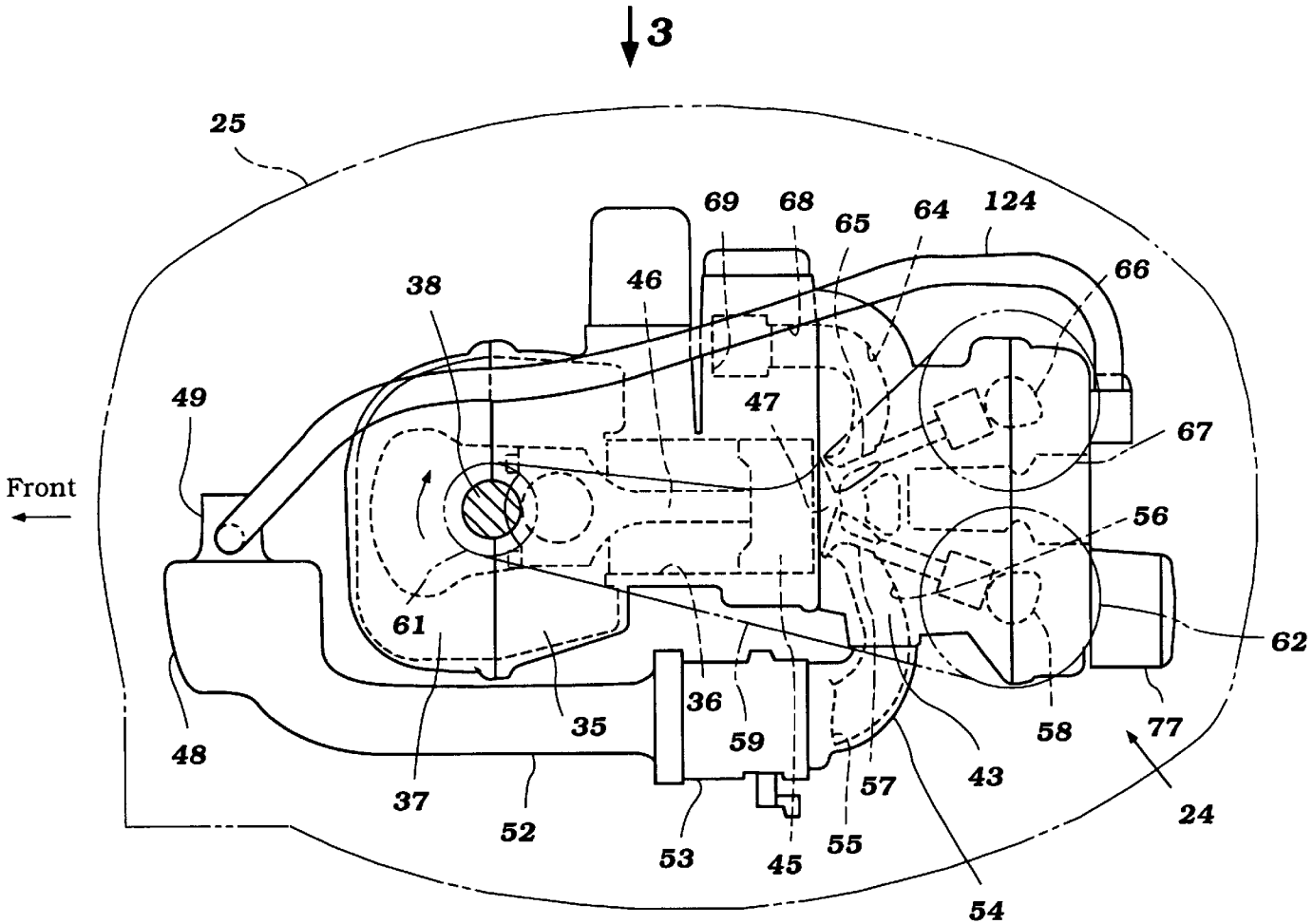
FIG. 2 is a top plan view of the outboard motor power head showing the engine in solid lines and the surrounding protective cowling in phantom.

Thus, the ventilating gases must flow downwardly along the wall 119 and then back upwardly to a ventilating gas discharge nipple 123 formed in the exterior of the cam cover 73 exhaust side 75. A flexible conduit 124 interconnects this discharge nipple 123 with the induction system inlet section 49, as best seen in FIG. 2 wherein this flexible conduit is more fully shown. Thus, the ventilating gases, rather than being discharged to the atmosphere, will be drawn back into the induction system. Although the circuitous path for the ventilating gases will ensure that oil will be returned back to the oil reservoir 79, any hydrocarbon vapors that may be retained will be passed back into the combustion chambers for further burning and purification therein.

It should also be noted that the intake side 74 of the cam cover 73 is provided with an oil fill section 125 via which oil may be filled into the reservoir 79 through the drain passages from the intake camshaft cavity 71 back to the oil reservoir 79 which have already been described.

Figure 12:
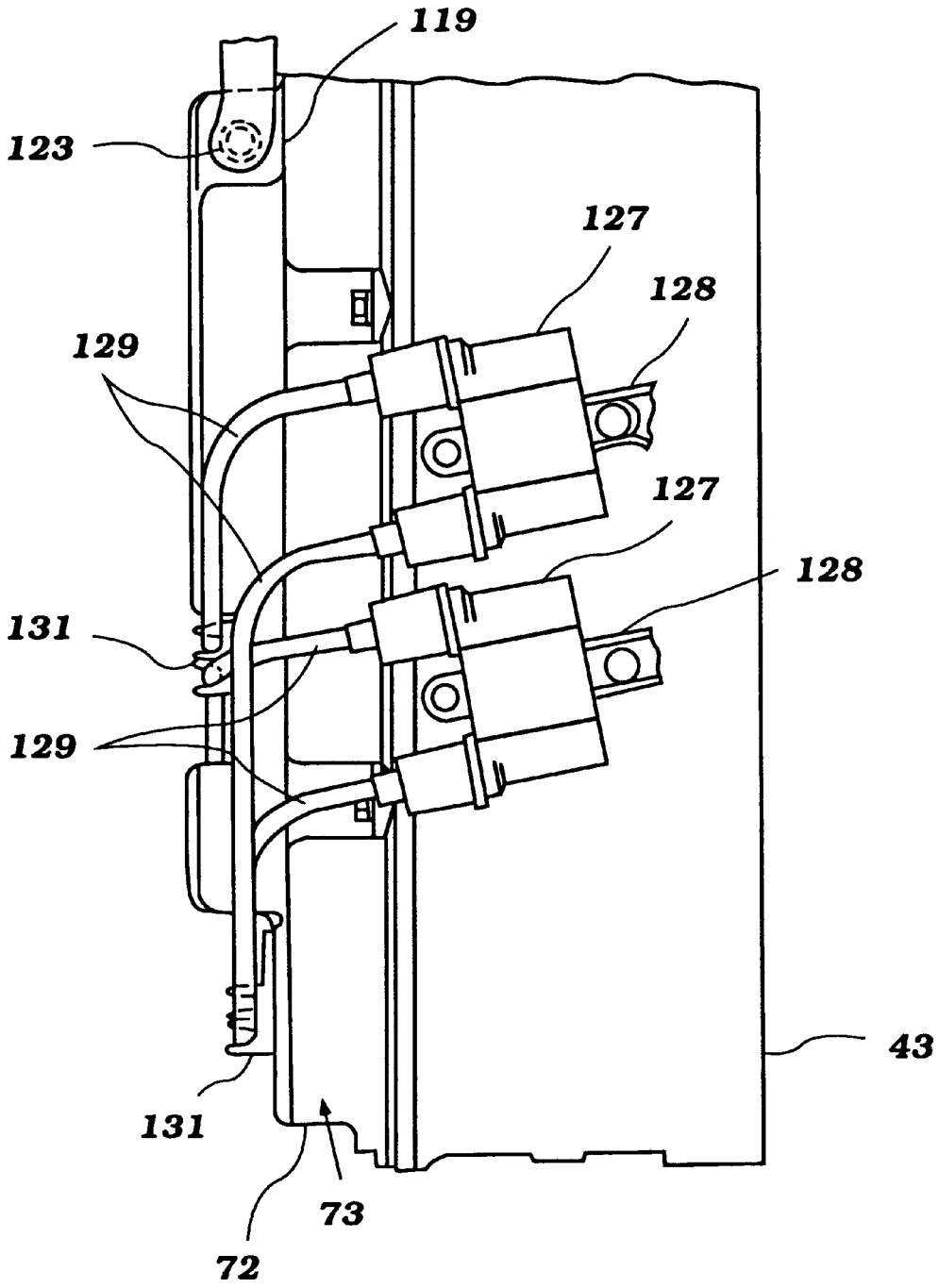
FIG. 12 is a side elevational view of the engine looking from the left hand side of the outboard motor and generally in the direction of the arrow 12 in FIG. 4.

It has been noted that the spark plugs 63 are fired by a suitable ignition system. A part of this ignition system is illustrated in the drawings and will now be described by primary reference to FIGS. 4 and 12. This includes a pair of spark coils 127 that are mounted on the exhaust side of the cylinder head 43 by mounting brackets 128.

These spark coils 127 each have a pair of cables or wires 129 leading from them and which terminate at the spark plugs 63. Counting the cylinder numbers from the top, the spark coil 127 serves cylinder numbers 1 and 4 while the lower spark coil 127 serves the cylinders 2 and 3. In order to maintain the spark plug wires 129 in their spaced relationship, spacer retainer members 131 are fixed to the cam cover 73 and specifically the exhaust side 75 thereof. This provides a neat appearance and facilitates servicing.

Figure 13:
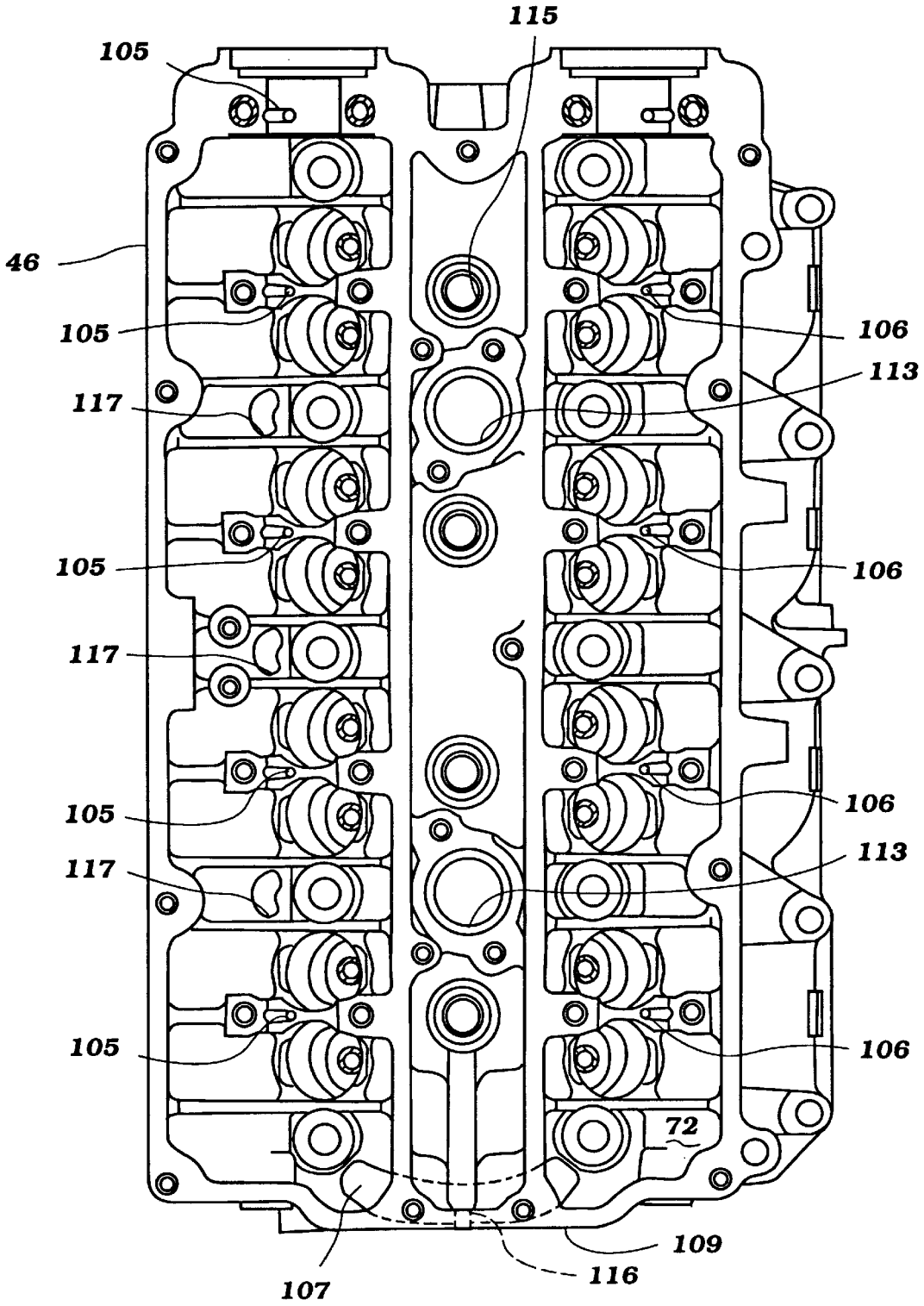
FIG. 13 is a rear elevational view of a cylinder head showing another embodiment of the invention and is in part similar to FIG. 9.

In the embodiment as thus far described, the cam chambers 71 and 72 for the intake and exhaust camshafts 58 and 66 were connected both through the lower restricted passageway 107 formed in the cylinder head and also the upper, more unrestricted passageway 118. If desired, more controlled flow of the crankcase ventilating gases can be obtained by eliminating the upper passageway 118 and FIG. 13 shows such an embodiment. In this embodiment, all other components are the same and for that reason, those components have been identified by the same reference numerals and will not be described again because the overall construction is believed to be readily apparent to those skilled in the art.

Figure 15:
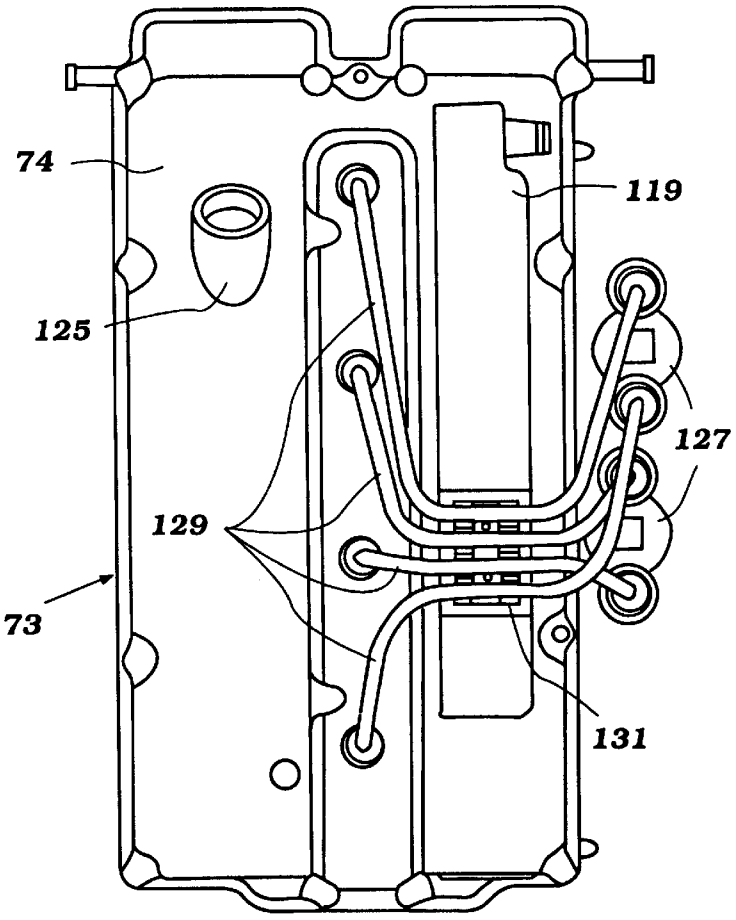
FIG. 15 is a partial rear elevational view, in part similar to FIGS. 4 and 14 and shows yet another embodiment.
Figure 14:
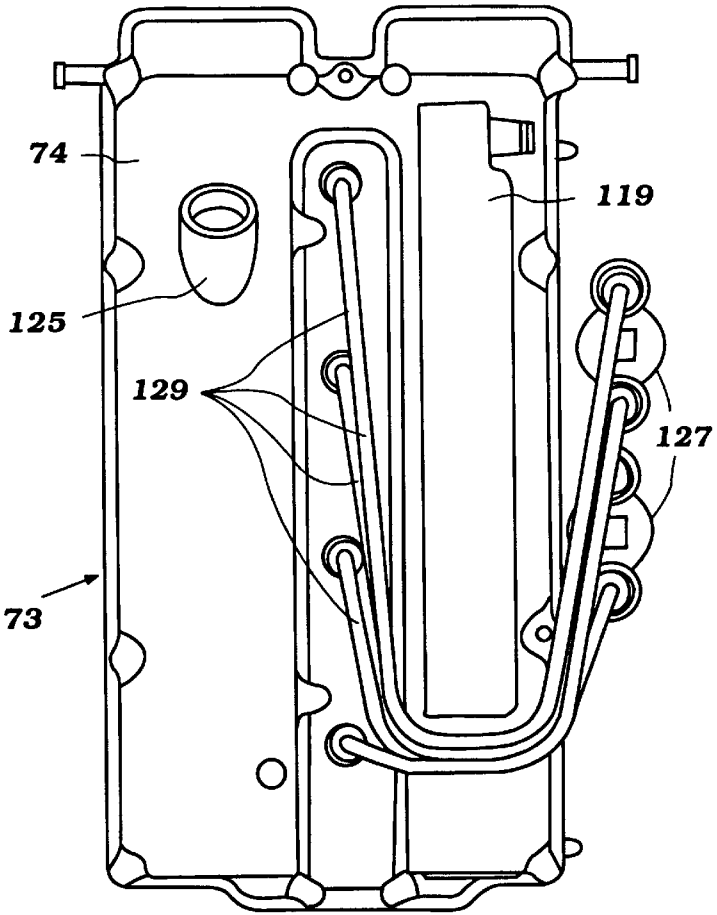
FIG. 14 is a partial rear elevational view, in part similar to FIG. 4, and shows another embodiment.

FIGS. 14 and 15 show two alternative arrangements for the spark plug wires or cables 129. In these embodiments, the spark coils 127 are positioned in the same location and they serve the same cylinders as previously described. In the embodiment of FIG. 14, however, all of the spark plug cables 129 cross over the cam cover at a point below the vapor separator 119 so as to keep them in a more closely arrayed arrangement.

In the embodiment of FIG. 15, all of the cables 129 cross over the vapor separator 119 at the same location. Thus, a single wire separator and retainer 131 may be utilized for the cables 129 from each of the coils 127.

Thus, from the foregoing description, it should be readily apparent that the described engine construction provides good crankcase ventilation and also an effective drain arrangement for returning the oil back to the oil reservoir. This is done even though the crankshaft rotates about a vertically extending axis and the crankcase chamber also so extends.

Of course, the foregoing description is that of preferred embodiments of the invention and various changes and modifications may be made without departing from the spirit and scope of the invention, as defined by the appended claims.

What is claimed is:

1. An outboard motor having a power head consisting of a four-cycle, overhead camshaft, internal combustion engine and a surrounding protective cowling, said engine having a crankshaft and at least one camshaft driven by said crankshaft for operating at least one valve in a cylinder head of said engine, a drive shaft housing and lower unit depending from said power head and containing a propulsion device driven by a transmission including a drive shaft for propelling an associated watercraft, means for coupling said crankshaft to said drive shaft, said engine being supported so that said crankshaft and said camshaft rotate about vertically extending axes, said crankshaft being journaled in a crankcase chamber formed at one end of a cylinder block and said camshaft being supported for rotation in a camshaft chamber formed in said cylinder head at the other end of said cylinder block, and an oil reservoir provided for said engine in the area at the upper end of said drive shaft housing and lower unit, said camshaft chamber and said crankcase chamber each have independent drains directly to said oil reservoir and which have no common passage with which they communicate.

2. An outboard motor as set forth in claim 1 wherein there are a pair of camshafts each rotatably journaled within a respective camshaft chamber formed by the cylinder head and wherein both camshaft chambers drain to the oil reservoir through a common drain.

3. An outboard motor as set forth in claim 2 wherein the camshaft chambers of the cylinder head communicate with each other through a restricted passageway formed at the lower end of the cylinder head and which restricted passageway communicates with a common camshaft chamber drain to the oil reservoir.

4. An outboard motor as set forth in claim 3 wherein the common camshaft chamber drain communicates with the oil reservoir through a drain passage formed in an upper portion of the cylinder block that is spaced from the crankcase chamber drain.

5. An outboard motor as set forth in claim 3 wherein the separate camshaft crankcase chambers also communicate with each other at the top of the cylinder head.

6. An outboard motor as set forth in claim 1 further including a crankcase ventilating system for delivering crankcase gases through said cylinder block to a first of the camshaft chambers, from that camshaft chamber to the other of the camshaft chambers and from that other camshaft chamber to an induction system of the engine.

7. An outboard motor as set forth in claim 6 wherein the cylinder block has a plurality of horizontally extending, vertically spaced cylinder bores.

8. An outboard motor as set forth in claim 7 wherein the crankcase chamber communicates with the one camshaft chamber through at least one passage formed on one side of the cylinder block.

9. An outboard motor as set forth in claim 8 wherein the cylinder block is formed with a plurality of passages formed between the cylinders all on the one side of the cylinder block for communicating the crankcase chamber with the one camshaft chamber.

10. An outboard motor as set forth in claim 9 wherein the one camshaft chamber communicates with the other camshaft chamber at one end thereof.

11. An outboard motor as set forth in claim 10 wherein the other camshaft chamber communicates with the induction system at the end thereof opposite where it communicates with the one camshaft chamber.

12. An outboard motor as set forth in claim 11 further including an oil vapor separator formed in a cover that covers at least the other camshaft chamber for separating oil from the ventilating gases.

13. An outboard motor as set forth in claim 1 wherein crankshaft is journaled in the crankcase chamber by a plurality of main bearings including a lower main bearing that is formed in a lowermost surface of the crankcase chamber, means for forming a pocket area in the area adjacent said lower main bearing, and a drain slot for communicating said pocket with the crankcase drain.

14. An outboard motor as set forth in claim 13 wherein there are a pair of camshafts each rotatably journaled within a respective camshaft chamber formed by the cylinder head and wherein both camshaft chambers drain to the oil reservoir through a common drain.

15. An outboard motor as set forth in claim 14 wherein the camshaft chambers of the cylinder head communicate with each other through a restricted passageway formed at the lower end of the cylinder head and which restricted passageway communicates with a common camshaft chamber drain to the oil reservoir.

16. An outboard motor as set forth in claim 15 wherein the common camshaft chamber drain communicates with the oil reservoir through a drain passage formed in an upper portion of the cylinder block that is spaced from the crankcase chamber drain.

17. An outboard motor as set forth in claim 15 wherein the separate camshaft crankcase chambers also communicate with each other at the top of the cylinder head.

* * * * *